US010815609B2

(12) United States Patent
Renz et al.

(10) Patent No.: US 10,815,609 B2
(45) Date of Patent: Oct. 27, 2020

(54) FRONT LOAD WASHING MACHINE APPLIANCE EQUIPPED WITH DOOR REVERSING LOCKING AND LATCHING FEATURES

(71) Applicant: Haier US Appliance Solutions, Inc., Wilmington, DE (US)

(72) Inventors: Daniel Stephen Renz, Louisville, KY (US); Erick Flores Islas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 209 days.

(21) Appl. No.: 16/030,899

(22) Filed: Jul. 10, 2018

(65) Prior Publication Data

US 2020/0018012 A1 Jan. 16, 2020

(51) Int. Cl.

| | |
|---|---|
| ***D06F 39/14*** | (2006.01) |
| ***E05B 59/00*** | (2006.01) |
| ***E05B 65/00*** | (2006.01) |
| ***E05B 65/06*** | (2006.01) |

(52) U.S. Cl.

CPC ..... *D06F 39/14* (2013.01); *E05B 59/00* (2013.01); *E05B 65/001* (2013.01); *E05B 65/06* (2013.01)

(58) Field of Classification Search

CPC ..... D06F 39/14; E05B 65/001; E05B 65/06; E05B 59/00; E05D 15/50; E05D 7/02; E05Y 2900/312

See application file for complete search history.

(56) References Cited

U.S. PATENT DOCUMENTS

| | | | | |
|---|---|---|---|---|
| 5,195,647 | A | 3/1993 | Studt | |
| 8,382,216 | B2 | 2/2013 | Favaro et al. | |
| 9,752,272 | B2 | 9/2017 | Yeom et al. | |
| 2010/0077803 | A1* | 4/2010 | Lim | D06F 37/28 68/212 |
| 2015/0115630 | A1* | 4/2015 | Tarr | E05C 19/16 292/251.5 |
| 2017/0342633 | A1* | 11/2017 | Son | D06F 39/08 |

FOREIGN PATENT DOCUMENTS

| | | | | |
|---|---|---|---|---|
| CN | 204715078 | U | 10/2015 | |
| DE | 102012202745 | A1 * | 8/2013 | D06F 39/14 |
| EP | 0331643 | A2 * | 9/1989 | D06F 39/14 |

(Continued)

*Primary Examiner* — Joseph L. Perrin
*Assistant Examiner* — Irina Graf
(74) *Attorney, Agent, or Firm* — Dority & Manning, P.A.

(57) ABSTRACT

A washing machine appliance equipped with door reversing locking and latching features is provided. Particularly, the washing machine appliance includes latching assembly that is movable between various mounting positions and is configured to hold the door in a closed position. A hinge assembly rotatably couples the door with a cabinet of the washing machine appliance and is movable between various mounting positions so that the door swing direction may be reversed. The washing machine appliance also includes a locking assembly for locking the door in the closed position, e.g., during operation of the washing machine appliance. The locking assembly is separate and distinct from the latching assembly and need not be moved when reversing the swing direction of the door.

18 Claims, 5 Drawing Sheets

(56) References Cited

FOREIGN PATENT DOCUMENTS

| | | | | | |
|---|---|---|---|---|---|
| EP | 1964962 | A1 * | 9/2008 | ..... | D06F 39/14 |
| EP | 2050860 | A2 * | 4/2009 | ..... | D06F 39/14 |
| EP | 2147996 | B1 | 4/2014 | | |
| JP | 2009125427 | A * | 6/2009 | ..... | D06F 39/14 |
| JP | 2018007827 | A * | 1/2018 | ..... | D06F 39/14 |
| WO | WO-2005042891 | A1 * | 5/2005 | ..... | E05D 15/507 |
| WO | WO-2005130247 | A1 * | 3/2015 | ..... | D06F 39/14 |

* cited by examiner

FRONT LOAD WASHING MACHINE APPLIANCE EQUIPPED WITH DOOR REVERSING LOCKING AND LATCHING FEATURES

FIELD OF THE INVENTION

The present disclosure relates generally to washing machine appliances and more particularly to front load or horizontal axis washing machine appliances equipped with door reversing locking and latching features.

BACKGROUND OF THE INVENTION

Front load washing machine appliances generally include a drum or basket rotatably mounted within a tub of a cabinet. The basket defines a wash chamber for receiving articles for washing. During operation, wash fluid is directed into the tub and onto articles within the wash chamber. A motor rotatably drives the basket at various speeds to agitate the articles within the wash chamber, to wring wash fluid from the articles, etc.

Some washing machine appliances include reversible door assemblies that allow a user to switch or reverse the swing direction of a door of the washing machine appliance, e.g., from a left swing direction to a right swing direction or vice versa. Conventional reversible door assemblies have presented a number of challenges. For instance, some reversible door assemblies of conventional washing machine appliances include a combined latching and locking assembly for latching the door to a front panel of the cabinet and locking the door during operation. The locking assembly generally includes electromechanical components. To switch such combined latching and locking assemblies from one side of a loading opening to the other, the front panel of the cabinet must be removed, various wires must be disturbed, various electrical connections must be opened and reconnected, and various other tasks may need be completed. Consequently, switching combined latching and locking assemblies may be complex, time consuming, and potentially dangerous. Attempts at solving such challenges have been unsuccessful or cost prohibitive. For instance, one solution for addressing such challenges includes placing a combined latching and locking assembly at both sides of the loading opening. While such a solution removes the need to move the assembly, such designs add significant cost to the unit.

Therefore, a front load or horizontal axis washing machine appliance that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one exemplary aspect, the present disclosure is directed to a front load appliance. The front load appliance includes a cabinet comprising a front panel defining a loading opening. The front load appliance also includes a tub disposed within the cabinet. Further, the front load appliance includes a drum rotatably mounted within the tub, the drum defining a chamber for receipt of articles for washing. Moreover, the front load appliance includes a door rotatably coupled with the front panel at one of a first mounting position and a second mounting position and movable between an open position and a closed position for selectively providing access to the chamber at the loading opening. In addition, the front load appliance includes a latching assembly comprising a latch and a striker. Further, the front load appliance includes a locking assembly spaced from the latching assembly when the door is in the closed position and comprising a lock and a locking feature. When the door is in the closed position, the striker engages the latch to secure the door to the front panel and the lock engages the locking feature for locking the door during operation of the front load appliance.

In another exemplary aspect, the present disclosure is directed to a horizontal axis washing machine appliance. The horizontal axis washing machine appliance includes a cabinet comprising a front panel defining a loading opening. The horizontal axis washing machine appliance also includes a tub disposed within the cabinet. Further, the horizontal axis washing machine appliance includes a basket rotatably mounted within the tub, the basket defining a wash chamber for receipt of articles for washing. In addition, the horizontal axis washing machine appliance includes a lock connected to the front panel. Moreover, the horizontal axis washing machine appliance includes a latch removably mounted to the front panel and spaced from the lock. The horizontal axis washing machine appliance also includes a door rotatably coupled with the front panel at one of a first mounting position and a second mounting position and movable between an open position and a closed position for selectively providing access to the loading opening, wherein the door defines a locking feature. Further, the horizontal axis washing machine appliance includes a striker removably mounted to the door for engaging the latch when the door is in the closed position, the striker spaced from the locking feature, wherein the locking feature and the lock engage to lock the door in the closed position during operation of the horizontal axis washing machine appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
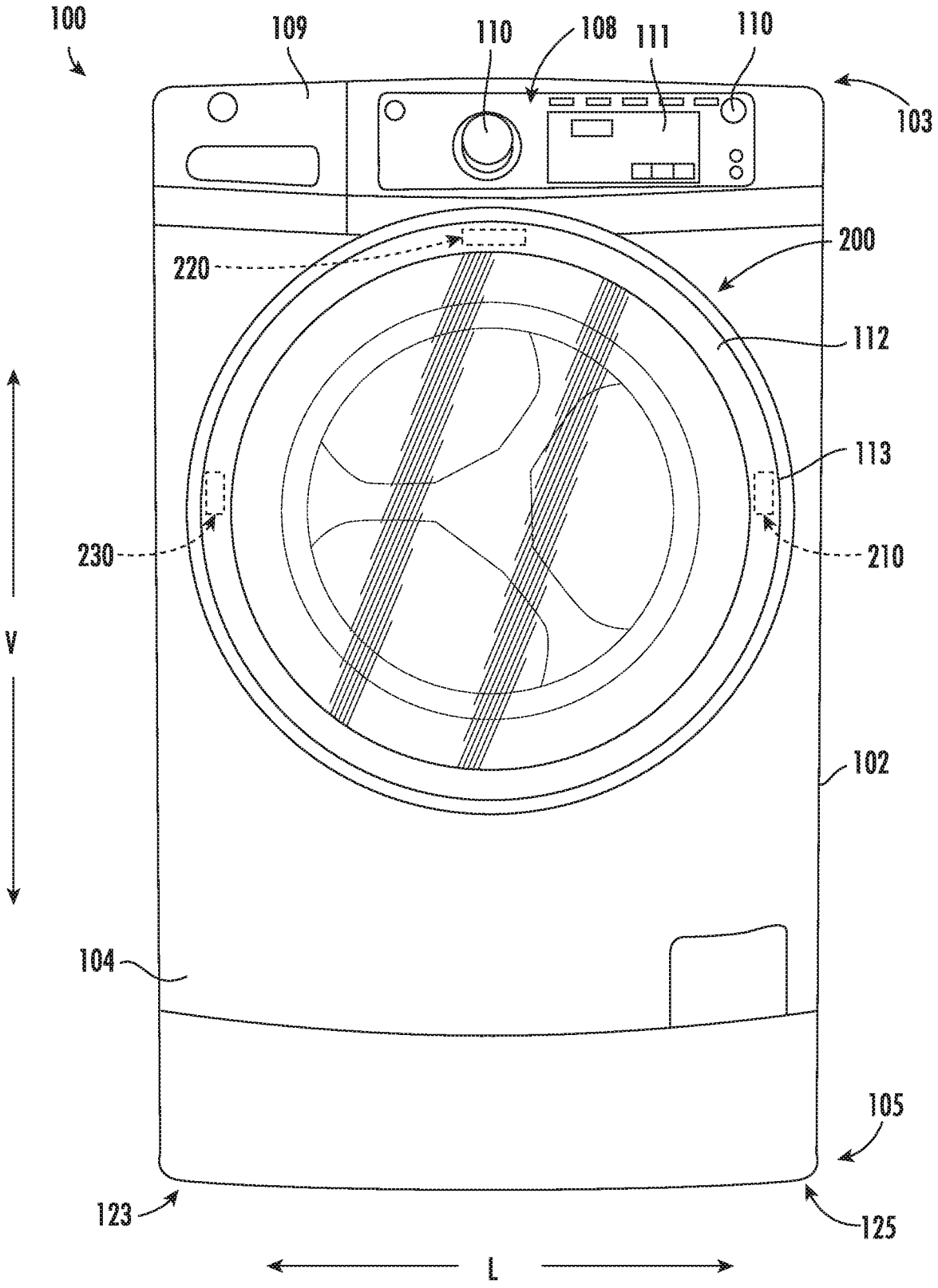
FIG. 1 provides a front, elevation view of a washing machine appliance according to an exemplary embodiment of the present disclosure and depicts a door of the washing machine appliance in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, the term "about" when used in reference to an angle means within fifteen degrees (15°) of the stated value or angle.

Figure 2:
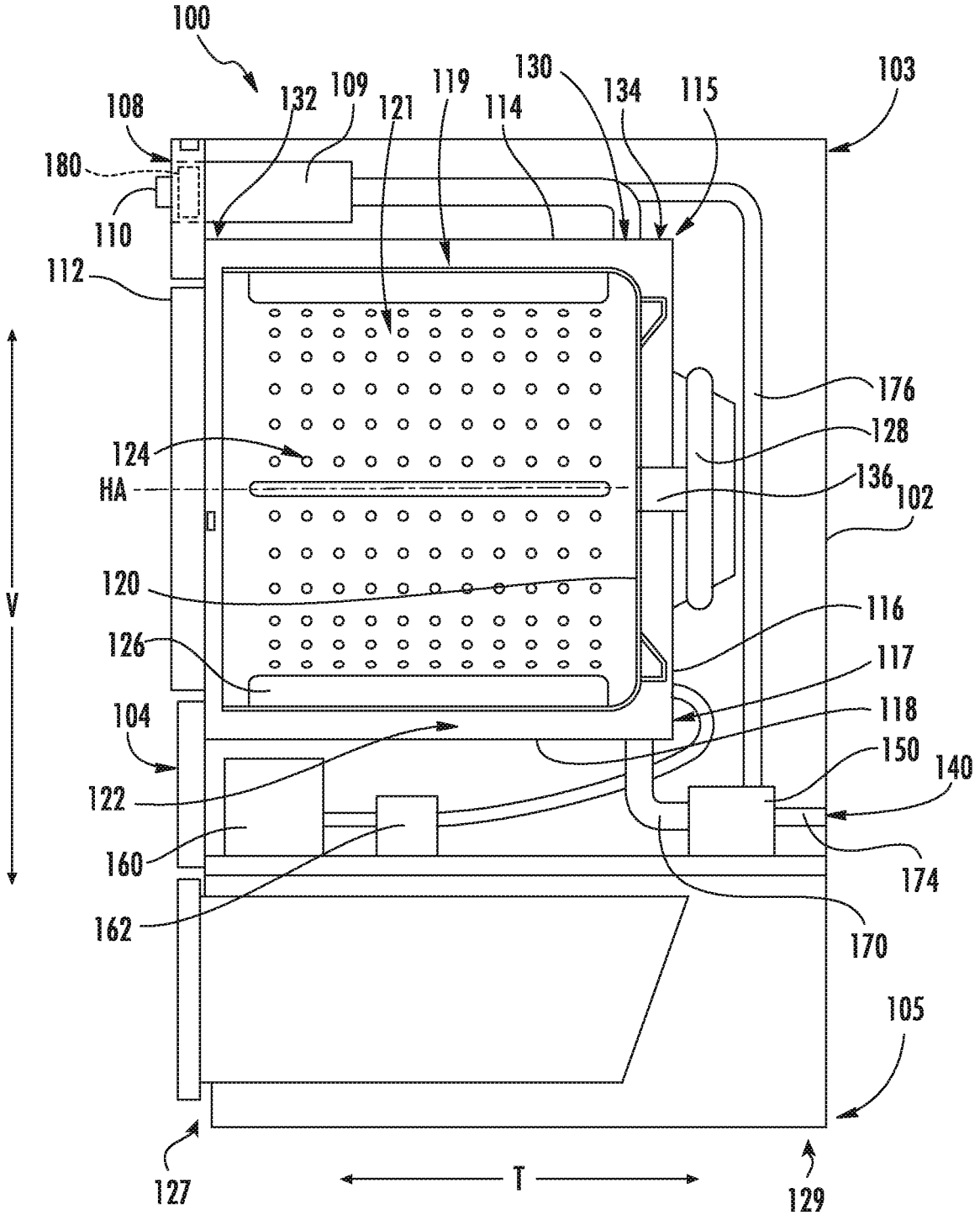
FIG. 2 provides a side, section view of the exemplary washing machine appliance of FIG. 1.

FIG. 1 provides a front view of an exemplary front load or horizontal axis washing machine appliance 100. As shown, washing machine appliance 100 defines a vertical direction V, a lateral direction L, and a transverse direction T (FIG. 2). The vertical, lateral, and transverse directions V, L, T defined by washing machine appliance 100 are mutually perpendicular and together define an orthogonal direction system. As depicted in FIG. 1, washing machine appliance 100 includes a cabinet 102 that extends between a top portion 103 and a bottom portion 105, e.g., along the vertical direction V. Cabinet 102 also extends between a first side 123 and a second side 125, e.g., along the lateral direction L, and between a front 127 and a rear 129, e.g., along the transverse direction T (FIG. 2).

While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. Thus, the teachings of the present disclosure are not limited to use with washing machine appliance 100.

Figure 3:
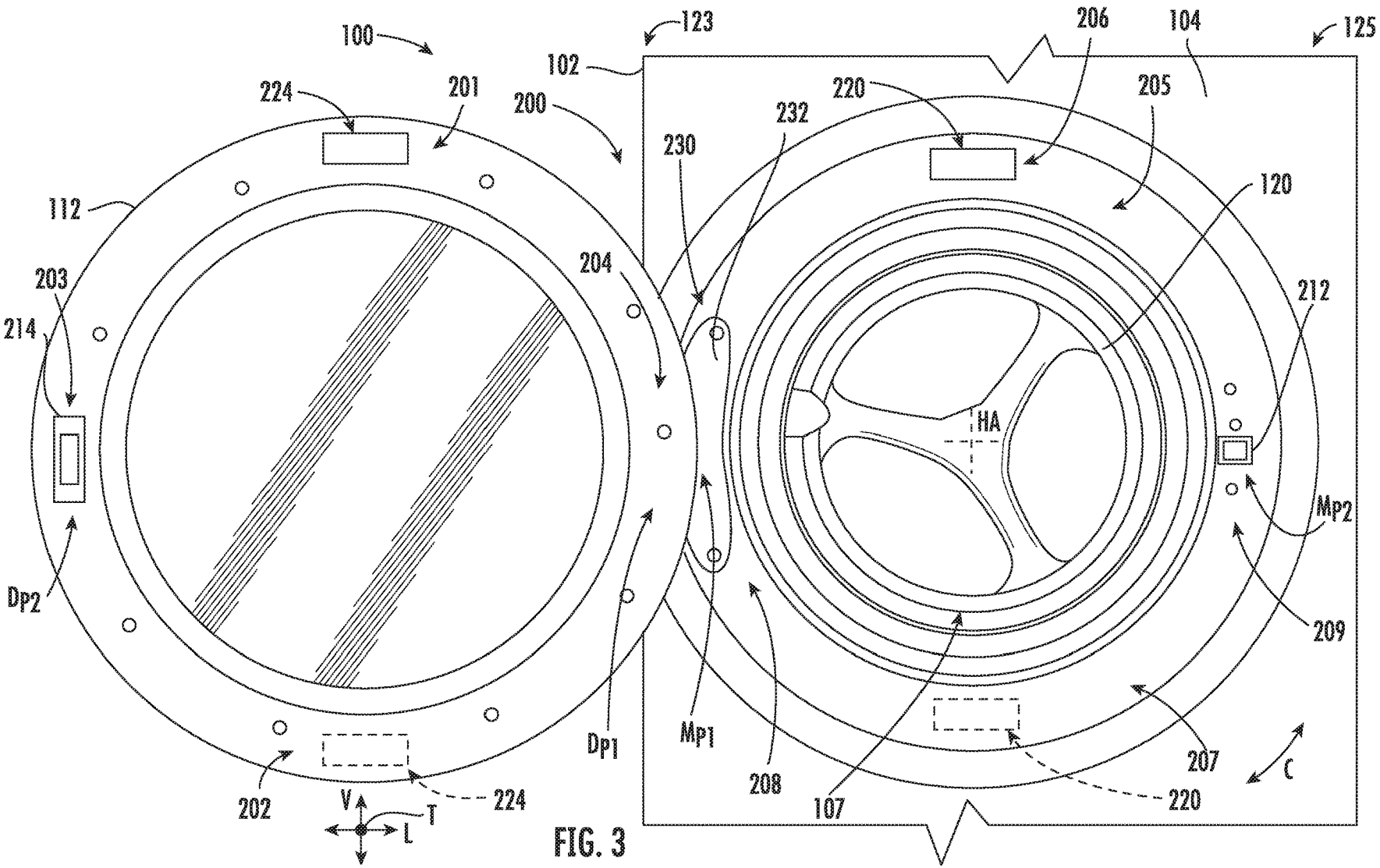
FIG. 3 provides a front view of the washing machine appliance of FIG. 1 depicting the door of the washing machine appliance in an open position and swingable in a left hand outswing direction.
Figure 4:
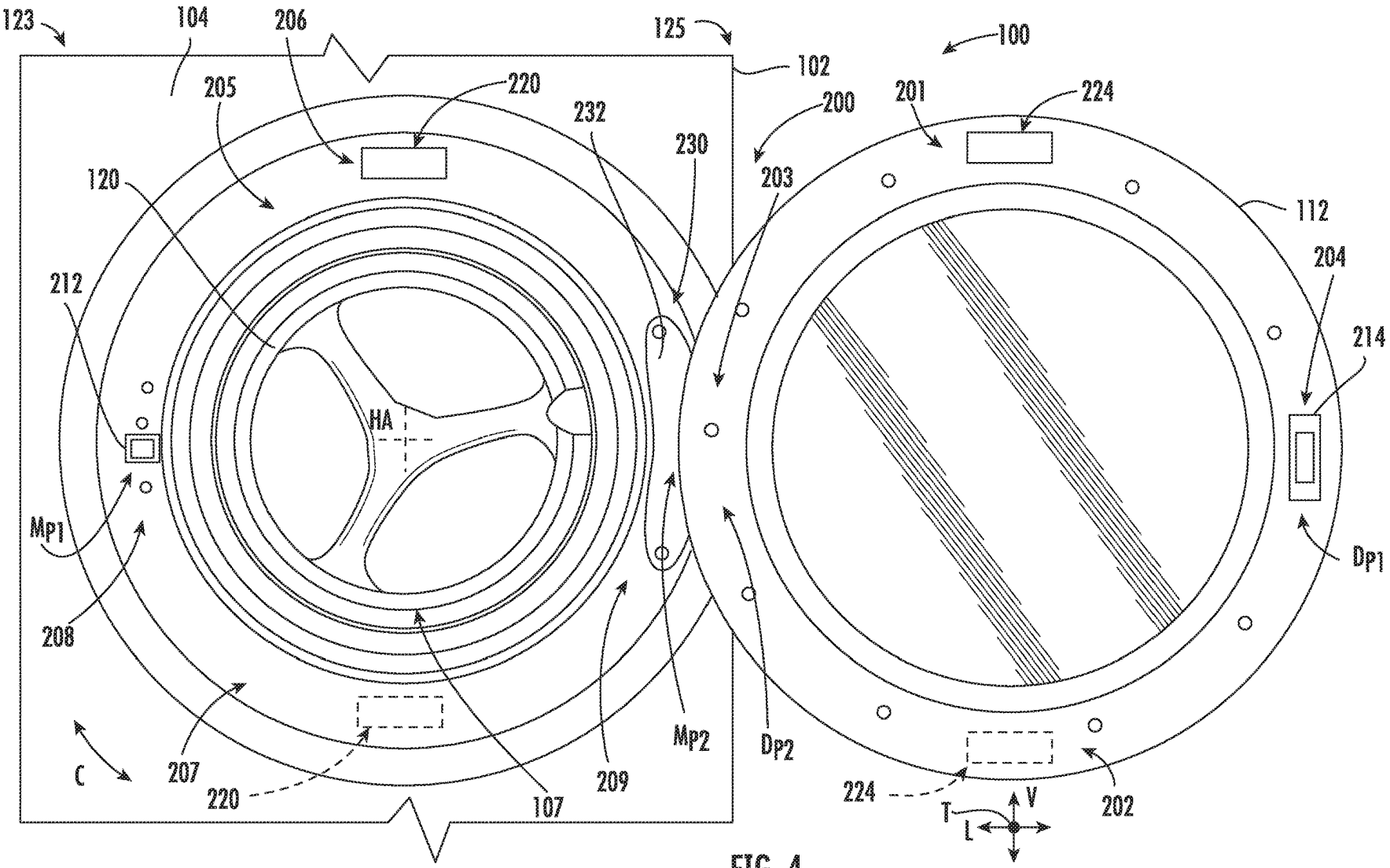
FIG. 4 provides a front view of the washing machine appliance of FIG. 1 depicting the door of the washing machine appliance in an open position and swingable in a right hand outswing direction.

Cabinet 102 includes a front panel 104. Front panel 104 defines a loading opening 107 (FIGS. 3 and 4). A door 112 is rotatably coupled or mounted to front panel 104 between an open position (FIGS. 3 and 4) and a closed position (FIGS. 1 and 2). When door 112 is in the open position, access to a wash drum or basket 120 located within cabinet 102 is facilitated, and in contrast, when door 112 is in the closed position, access to basket 120 is hindered. Further, in the closed position, door 112 covers loading opening 107. A user may pull on a handle 113 in order to adjust door 112 between the open position and the closed position. A control panel 108 that includes a plurality of input selectors 110 is coupled to front panel 104. Control panel 108 and input selectors 110 collectively form a user interface input for operator selection of machine cycles and features. For example, in one embodiment, a display 111 (FIG. 1) indicates selected features, a countdown timer, and/or other items of interest to machine users.

FIG. 2 provides a side, section view of the exemplary washing machine appliance of FIG. 1. As shown, washing machine appliance 100 includes a tub 114. Tub 114 defines a wash fluid compartment 119 configured for receipt of a washing fluid. Thus, tub 114 is configured for containing washing fluid, e.g., during operation of washing machine appliance 100. Washing fluid disposed within tub 114 may include at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121. An opening of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 122 is defined by tub 114 and is configured for receipt of washing fluid during operation of appliance 100. For example, during operation of appliance 100, washing fluid may be urged by gravity from basket 120 to sump 122 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 122 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 122 to drain 140 during operation of appliance 100 in order to remove fluid from tub 114. Fluid received by drain 140 from pump assembly 150 is directed out of appliance 100, e.g., to a sewer or septic system.

In addition, pump assembly 150 may be configured for recirculating washing fluid within tub 114. Thus, pump assembly 150 may be configured for urging fluid from sump 122, e.g., to spout 130. For example, pump assembly 150 may urge washing fluid in sump 122 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a horizontal axis HA, e.g., during a spin cycle. Ribs 126 extend from basket 120 into wash chamber 121. Ribs 126 assist agitation of articles disposed within wash chamber 121 during operation of washing machine appliance 100. For example, ribs 126 may lift articles disposed in basket 120 during rotation of basket 120.

A dispenser 109 may be slidably mounted within front panel 104. In some embodiments, dispenser 109 may be a lid accessible at top portion 103 of cabinet 102. Dispenser 109 receives a fluid additive (e.g., detergent, fabric softener, bleach, or any other suitable liquid) and directs the fluid additive to wash fluid compartment 119 during operation of washing machine appliance 100. Additionally, a reservoir 160 is disposed within cabinet 102. Reservoir 160 is also configured for receipt of fluid additive for use during operation of washing machine appliance 100. Reservoir 160 is sized such that a volume of fluid additive sufficient for a plurality or multitude of wash cycles of washing machine appliance 100 may fill reservoir 160. Thus, for example, a user can fill reservoir 160 with fluid additive and operate washing machine appliance 100 for a plurality of wash cycles without refilling reservoir 160 with fluid additive. A reservoir pump 162 is configured for selective delivery of the fluid additive from reservoir 160 to tub 114.

Operation of washing machine appliance 100 is controlled by a processing device or controller 180 that is operatively coupled to control panel 108 for user manipulation to select washing machine cycles and features. In response to user manipulation of control panel 108, controller 180 operates the various components of washing machine appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of washing machine appliance 100 may be in communication with controller 180 via one or more signal lines or shared communication busses.

Controller 180 is in operative communication with motor 128. Thus, controller 180 can selectively activate and operate motor 128, e.g., depending upon a wash cycle selected by a user of washing machine appliance 100. Controller 180 may also be configured for monitoring a power delivered to motor 128. As will be understood by those skilled in the art, power delivered to motor 128 can be measured or determined by controller 180 utilizing various methods. Further, controller 180 may further be configured for determining a current speed of motor 128 according to any known techniques. For example, a speed signal describing the current speed of the motor can be created and provided to controller 180 according to back electromotive force techniques or based on the output of one or more sensors or other components including, for example, an optical sensor or magnetic-based sensors such as hall effect sensors.

In an illustrative example of operation of washing machine appliance 100 in a wash cycle, laundry items are loaded into basket 120, and washing operation is initiated through operator manipulation of input selectors 110. Tub 114 is filled with water and detergent to form a wash fluid. One or more valves (not shown) can be actuated by controller 180 to provide for filling tub 114 to the appropriate level for the amount of articles being washed. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

FIGS. 3 and 4 provide front views of the front load washing machine appliance 100 of FIGS. 1 and 2. More particularly, FIG. 3 provides a front view of washing machine appliance 100 depicting door 112 in an open position and swingable in a left-hand outswing direction and FIG. 4 provides a front view of washing machine appliance 100 depicting door 112 in an open position and swingable in a right-hand outswing direction. Thus, for this exemplary embodiment, washing machine appliance 100 includes a reversible door assembly 200. That is, reversible door assembly 200 allows users to change the opening or swing direction of door 112. Although FIGS. 3 and 4 depict door 112 swingable in a left-hand outswing direction (FIG. 3) and a right-hand outswing direction (FIG. 4) by reversible door assembly 200, it will be appreciated the inventive aspects of the present disclosure may apply to other swing directions as well, such as e.g., a top-to-bottom swing direction and a bottom-to-top swing direction.

Generally, as shown best in FIG. 1, reversible door assembly 200 includes a movable latching assembly 210, a locking assembly 220, and a movable hinge assembly 230, among other assemblies and components, such as door 112 and front panel 104 of cabinet 102. In accordance with exemplary aspects of the present disclosure, latching assembly 210 and locking assembly 220 are separate assemblies spaced from one another, and thus, the latching and locking functions of securing and locking door 112 in the closed position are handled separately. Latching assembly 210 holds door 112 in place in the closed position and ensures proper sealing between door 112 and front panel 104, e.g., to prevent water from leaking during a wash cycle. Once door 112 is positioned and held in the closed position by latching assembly 210, locking assembly 220 locks door 112 in the closed position during operation of washing machine appliance 100. For instance, when a user commences a cycle, locking assembly 220 locks door 112 in the closed position. In this way, users are prevented from inadvertently opening door 112 during operation. As will be explained further below, the separation of the latching and locking assemblies 210, 220 may provide numerous benefits, including reduced complexity and cost of the front load appliance, e.g., compared to conventional washing machine appliances with reversible door designs having two electromechanical door locking assemblies and/or reversible door designs with a movable locking assembly.

As shown in FIGS. 1, 3, and 4, latching assembly 210 includes a door catch or latch 212 and a striker 214. Generally, striker 214 is configured to engage latch 212 when door 112 is moved to the closed position (FIG. 1). In this way, door 112 may be held in place or secured to front panel 104 of cabinet 102 in the closed position. The latching of door 112 with cabinet 102 also ensures that a seal is made between door 112 and cabinet 102, e.g., by various sealing elements. In this manner, water and/or wash fluid is prevented from leaking out of wash chamber 121 during operation of washing machine appliance 100. Further, striker 214 is configured to disengage from latch 212 when a sufficient ergonomic force is applied to door 112, e.g., as shown in FIGS. 3 and 4. Latch 212 and striker 214 may be any suitable type of latch and striker, respectively. For instance, striker 214 may be a loop or pin configured to engage a hook or spring-loaded catch of latch 212.

For this embodiment, striker 214 is removably attached or connected to door 112 and latch 212 is removably attached or connected to front panel 104 of cabinet 102. Stated differently, latch 212 is removably mounted to front panel 104 and striker 214 is removably mounted to door 112. Striker 214 and latch 212 may be mounted in various mounting positions. For instance, as shown in FIGS. 3 and 4, latch 212 may be mounted at a first mounting position MP1 (FIG. 4) or at a second mounting position MP2 (FIG. 3). The first mounting position MP1 is located adjacent loading opening 107 at a first side 208 of a door recess 205 defined by front panel 104 (generally a nine o'clock position) and the second mounting position MP2 is located adjacent loading opening 107 and a second side 209 of door recess 205 (generally a three o'clock position). The first mounting position MP1 is located opposite the second mounting position MP2. That is, the first mounting position MP1 is spaced from the second mounting position MP2 about one hundred eighty degrees (180°) with respect to the horizontal axis HA along a circumferential direction C. The circumferential direction C is defined by the washing machine appliance 100 and extends three hundred sixty degrees (360°) about the horizontal axis HA. When latch 212 is mounted to front panel 104 at the first mounting position MP1 (FIG. 4), a hinge body 232 of hinge assembly 230 is mounted to front panel 104 at the second mounting position MP2. In contrast, when latch 212 is mounted to front panel 104 at the second mounting position MP2 (FIG. 3), hinge body 232 is mounted to front panel 104 at the first mounting position MP1. In this way, no matter the swing direction configuration, striker 214 may engage latch 212 at a position opposite where door 112 is rotatably mounted to front panel 104.

Similarly, striker 214 may be mounted at a first door mounting position DP1 or at a second door mounting position DP2. The first door mounting position DP1 is located opposite the second door mounting position DP2. That is, the first door mounting position DP1 is spaced from the second door mounting position DP2 about one hundred eighty degrees (180°) with respect to the horizontal axis HA along the circumferential direction C. When door 112 is moved to the closed position, the first mounting position MP1 is aligned with the first door mounting position DP1 and the second mounting position MP2 is aligned with the second door mounting position DP2.

In some alternative exemplary embodiments, latching assembly 210 may include two latches, including one latch attached to or integral with door 112 at the first mounting position MP1 and one latch attached to or integral with door 112 at the second mounting position MP2. In such embodiments, a user need not move the latch from one mounting position to the other. Further, in such embodiments, a movable hinge body 232 may be mounted to front panel 104 over the latch that is not in use. Further, in some embodiments, latch 212 is removably attached or connected to door 112 and striker 214 is removably attached or connected to front panel 104.

As further shown in FIGS. 3 and 4, locking assembly 220 includes a lock 222 and a locking feature 224. Generally, unlike the removably mounted components of latching assembly 210 and hinge assembly 230, the components of locking assembly 220 are not removably mounted to their respective components; rather, the components of locking assembly 220 are fixed in place and are not movable to different mounting positions. For this embodiment, lock 222 is connected to front panel 104 and locking feature 224 is defined by door 112. When door 112 is in the closed position (and held or secured in place by latching assembly 210), a locking member 226 (FIGS. 5 through 7) of lock 222 engages locking feature 224 for locking door 112 during operation of washing machine appliance 100, e.g., during a wash cycle. In some alternative embodiments, lock 222 is connected to door 112 and locking feature 224 is defined by front panel 104.

Figure 5:
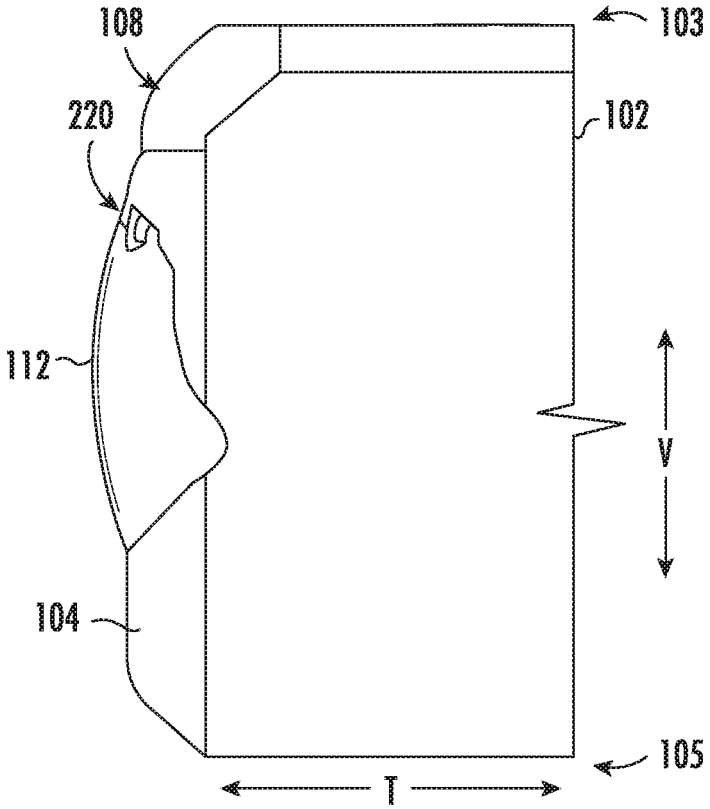
FIGS. 5 through 7 provide various schematic views of a locking assembly of the washing machine appliance of FIG. 1.
Figure 6:
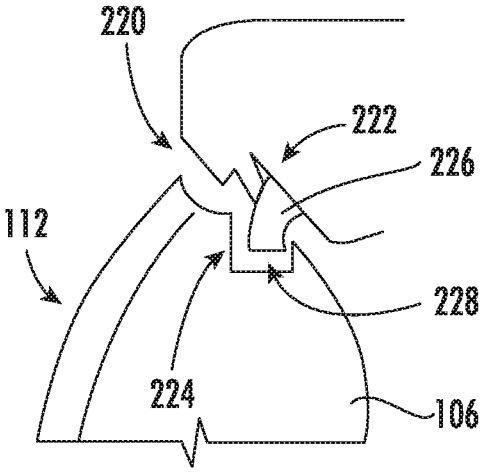
Figure 7:
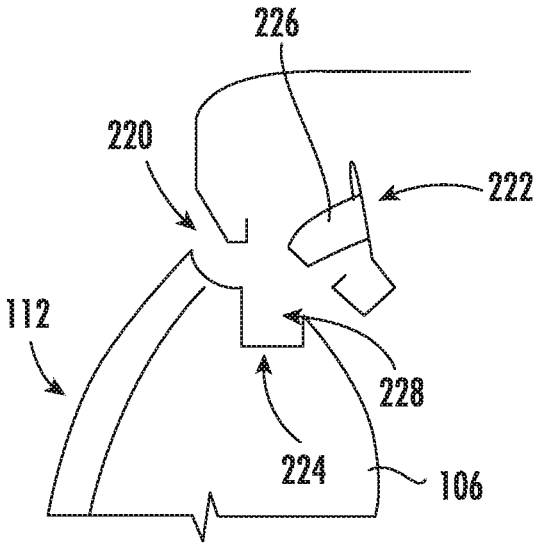

FIGS. 5 through 7 provide various schematic views of locking assembly 220. More specifically, FIG. 5 provides a schematic side view of washing machine appliance 100 depicting locking assembly 220, FIG. 6 provides a close up view of locking assembly 220 shown in a locked position, and FIG. 7 provides a close up view of locking assembly 220 shown in an unlocked position. As shown, lock 222 of locking assembly 220 includes locking member 226 that is movable between a retracted position (FIG. 7) and a withdrawn position (FIGS. 5 and 6). Locking member 226 is a locking bolt in this embodiment. Locking member 226 may be moved between the withdrawn and retracted positions by any suitable mechanism. For instance, in some exemplary embodiments, lock 222 is an electromechanical locking device that includes switch contacts, a solenoid, motor, or a linear actuator, and one or more wires that provide electrical power to move locking member 226 between the withdrawn and retracted positions. Further, for this exemplary embodiment, locking feature 224 of door 112 is a recess 228 defined by door 112. Particularly, a frame or window of door 112 may define recess 228. As shown best in FIGS. 6 and 7, a window 106 of door 112 defines recess 228 for this embodiment.

When locking assembly 220 is in the locked position as shown in FIG. 6, locking member 226 is deployed in the withdrawn position. That is, locking member 226 is deployed or withdrawn such that at least a portion of locking member 226 is received within recess 228 of door 112. In this way, recess 228 is sized to receive or accommodate at least a portion of locking member 226, e.g., when locking member 226 is in the withdrawn position. Washing machine appliance 100 may deploy or withdraw locking member 226, e.g., when a user commences a cycle. For instance, when a user commences a cycle, controller 180 (FIG. 2) may send one or more lock command signals to lock 222 commanding lock 222 to lock door 112, or more particularly, to move locking member 226 to the withdrawn position. Controller 180 may likewise send unlock signals to lock 222 commanding lock 222 to unlock door 112, or more specifically, to move locking member 226 to the retracted position as shown in FIG. 7, e.g., after the completion of the cycle or when water is drained from wash basket 120. It will be appreciated that the locking assembly 220 depicted in FIGS. 5 through 7 is provided by way of example and that locking assembly 220 may have other suitable configurations for locking door 112 in the closed position during operation of washing machine appliance 100.

With reference again to FIGS. 3 and 4, notably, locking assembly 220 is spaced from latching assembly 210 when door 112 is in the closed position (FIG. 1). Thus, latching assembly 210 and locking assembly 220 are distinct assemblies. As depicted in FIGS. 3 and 4, for this embodiment, the first mounting position MP1 is disposed about ninety degrees (90°) from locking assembly 220 with respect to the horizontal axis HA and the second mounting position MP2 is disposed about ninety degrees (90°) from the locking assembly 220 with respect to the horizontal axis HA. Stated differently, in both FIGS. 3 and 4, latching assembly 210 is spaced from locking assembly 220 about ninety degrees (90°) along the circumferential direction C when door 112 is in the closed position and hinge assembly 230 is spaced from latching assembly 210 about one hundred eighty degrees (180°) along the circumferential direction C when door 112 is in the closed position. Accordingly, for this embodiment, locking assembly 220 is centered or about centered between the mounting positions MP1, MP2, and thus, the mechanical advantage for opening door 112 is the same or approximately the same for both swing directions.

In some alternative embodiments, locking assembly 220 is disposed at some distance from the first mounting position MP1 and the second mounting position MP2 along the circumferential direction C. That is, locking assembly 220 need not be disposed about ninety degrees (90°) from the first mounting position MP1 and the second mounting position MP2 with respect to the horizontal axis HA along the circumferential direction C.

Further for the depicted embodiments of FIGS. 3 and 4, door 112 extends between a top 201 and a bottom 202, e.g., along the vertical direction V. Door 112 also extends between a first side 203 and a second side 204, e.g., along the lateral direction L. In such embodiments, locking feature 224 is centered between first side 203 and second side 204, e.g., along the lateral direction L, and is positioned at or adjacent top 201 of door 112. To ensure that locking member 226 of lock 222 may engage locking feature 224 of door 112 when door 112 is in the closed position, lock 222 is positioned such that locking member 226 may engage locking feature 224 when door 112 is in the closed position. More particularly, as shown in FIGS. 3 and 4, front panel 104 defines door recess 205 extending annularly about loading opening 107. Door recess 205 extends between a top 206 and a bottom 207, e.g., along the vertical direction V, and between first side 208 and second side 209, e.g., along the lateral direction L. Further, lock 222 is centered between first side 208 and second side 209, e.g., along the lateral direction L, and is positioned at or proximate top 206 of door recess 205. Accordingly, lock 222 and locking feature 224 are positioned such that locking member 226 of lock 222 may engage locking feature 224 when door 112 is moved to the closed position. As locking assembly 220 is positioned at or proximate the top of loading opening 107 (e.g., at a twelve o'clock position), water or wash fluid that drips from laundry articles during removal is prevented from splashing or dripping onto locking assembly 220, which as noted above, may include various electrical components, including high voltage wires.

In some alternative embodiments, locking feature 224 is centered between first side 203 and second side 204, e.g., along the lateral direction L, and is positioned at or proximate bottom 202 of door 112 (locking feature 224 positioned at or proximate bottom 202 is shown in dashed lines in FIGS. 3 and 4). To ensure that locking member 226 of lock 222 may engage locking feature 224 of door 112 when door 112 is in the closed position, lock 222 is positioned such that locking member 226 may engage locking feature 224 when door 112 is in the closed position. More particularly, lock 222 is centered between first side 208 and second side 209, e.g., along the lateral direction L, and is positioned at or proximate bottom 207 of door recess 205 (lock 222 positioned at or proximate bottom 202 is shown in dashed lines in FIGS. 3 and 4). Accordingly, lock 222 and locking feature 224 are positioned such that locking member 226 of lock 222 may engage locking feature 224 when door 112 is moved to the closed position. As locking assembly 220 is positioned at the bottom of loading opening 107 (e.g., at a six o'clock position), locking assembly 220 is centered or about centered between the mounting positions MP1, MP2, and thus, the mechanical advantage for opening door 112 is the same or approximately the same for both swing directions.

The separate latching and locking assemblies 210, 220 of reversible door assembly 200 described above separates the latching and locking functionality of securing door 112 in the closed position. By separating latching assembly 210 and locking assembly 220, numerous benefits are realized. For instance, locking assembly 220 need not be moved to reverse the swing direction of door 112; locking assembly 220 remains fixed in place. Further, as latching assembly 210 is simplified by separation of the locking features, the features of latching assembly 210 may be mounted at one of the mounting positions more easily and in a safer manner, e.g., without disturbing wires or making electrical connections, some of which may be high voltage. Thus, reversing the door swing direction can be done safely and reliably by users without electrical training or knowledge. In addition, the separation of the latching and locking assemblies 210, 220 provides a redundant door seal, which is particularly advantageous for front load washing machine appliances. Moreover, by separating latching assembly 210 and locking assembly 220, there is no need for a specialized combined latching and locking assembly and thus a greater range of commercially available latching and locking assemblies become available for use with washing machine appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A front load appliance defining a vertical direction and a lateral direction, the front load appliance comprising:

a cabinet comprising a front panel defining a loading opening, wherein the front panel defines a door recess extending annularly about the loading opening, and wherein the door recess extends between a top and a bottom along the vertical direction and between a first side and a second side along the lateral direction;

a tub disposed within the cabinet;

a drum rotatably mounted within the tub, the drum defining a chamber for receipt of articles for washing;

a door rotatably coupled with the front panel at one of a first mounting position and a second mounting position and movable between an open position and a closed position for selectively providing access to the chamber at the loading opening;

a latching assembly comprising a latch and a striker; and a locking assembly spaced from the latching assembly when the door is in the closed position and comprising a lock and a locking feature, wherein the lock is centered between the first side and the second side of the door recess along the lateral direction and at or proximate the top of the door recess along the vertical direction;

wherein when the door is in the closed position, the striker engages the latch to secure the door to the front panel and the lock engages the locking feature for locking the door during operation of the front load appliance.

2. The front load appliance of claim 1, wherein the lock is connected to the front panel and the locking feature is defined by the door.

3. The front load appliance of claim 1, wherein the lock comprises a locking member movable between a retracted position in which the door is unlocked and a withdrawn position in which the door is locked, and wherein the locking feature defined by the door is a recess sized to receive the locking member.

4. The front load appliance of claim 1, wherein the latch is removably mounted to the front panel and the striker is removably mounted to the door.

5. The front load appliance of claim 1, wherein the front load appliance defines a horizontal axis about which the drum rotates, and wherein the front load appliance further defines a circumferential direction extending about the horizontal axis, and wherein the latching assembly is spaced from the locking assembly about ninety degrees (90°) along the circumferential direction when the door is in the closed position.

6. The front load appliance of claim 5, further comprising:

a movable hinge assembly for rotatably mounting the door at one of the first mounting position and the second mounting position;

wherein the hinge assembly is spaced from the latching assembly about one hundred eighty degrees (180°) along the circumferential direction when the door is in the closed position.

7. The front load appliance of claim 1, wherein the front load appliance is a washing machine appliance.

8. A horizontal axis washing machine appliance, comprising:

a cabinet comprising a front panel defining a loading opening;

a tub disposed within the cabinet;

a basket rotatably mounted within the tub, the basket defining a wash chamber for receipt of articles for washing;

a lock connected to the front panel;

a latch removably mounted to the front panel and spaced from the lock;

a door rotatably coupled with the front panel at one of a first mounting position and a second mounting position and movable between an open position and a closed position for selectively providing access to the loading opening, wherein the door defines a locking feature; and a striker removably mounted to the door for engaging the latch when the door is in the closed position, the striker spaced from the locking feature;

wherein the locking feature and the lock engage to lock the door in the closed position during operation of the horizontal axis washing machine appliance; and wherein the door extends between a top and a bottom along a vertical direction and a first side and a second side along a lateral direction, and wherein the locking feature is centered between the first side and the second side and is positioned at or proximate the top of the door.

9. The horizontal axis washing machine appliance of claim 8, wherein the first mounting position and the second mounting position are disposed on opposite sides of the loading opening defined by the front panel.

10. The horizontal axis washing machine appliance of claim 8, wherein the horizontal axis washing machine appliance defines a horizontal axis about which the basket rotates, and wherein the first mounting position is disposed about ninety degrees (90°) from the lock with respect to the horizontal axis and the second mounting position is disposed about ninety degrees (90°) from the lock with respect to the horizontal axis.

11. The horizontal axis washing machine appliance of claim 8, wherein the door is rotatably coupled with the front panel by a removable hinge assembly.

12. The horizontal axis washing machine appliance of claim 8, wherein the hinge assembly, the locking assembly, and the latching assembly are spaced about ninety degrees (90°) from one another when door is in the closed position.

13. The horizontal axis washing machine appliance of claim 8, wherein the lock comprises a locking member that is movable between a retracted position and a withdrawn position, and wherein when the door is in the closed position and the horizontal axis washing machine appliance is in operation, the locking member is in the withdrawn position and when the door is in the open position, the locking member is in the retracted position.

14. The horizontal axis washing machine appliance of claim 13, wherein the locking feature is a recess sized to accommodate at least a portion of the locking member when the locking member is in the withdrawn position.

15. The horizontal axis washing machine appliance of claim 8, wherein the front panel defines a door recess extending annularly about the loading opening, and wherein the door recess extends between a top and a bottom along the vertical direction and between a first side and a second side along the lateral direction, and wherein the lock is centered between the first side and the second side and is positioned at or proximate the top of the door recess, and wherein a hinge body of a hinge assembly is mounted to the door recess at one of the first side and the second side, and wherein the latch is mounted to the door recess opposite the hinge body at one of the first side and the second side.

16. A horizontal axis washing machine appliance, comprising:

a cabinet comprising a front panel defining a loading opening;

a tub disposed within the cabinet; a basket rotatably mounted within the tub, the basket defining a wash chamber for receipt of articles for washing;

a locking bolt coupled to the front panel and movable between a retracted position and a withdrawn position;

a latch removably mounted to the front panel and spaced from the locking bolt; a door rotatably coupled with the front panel at one of a first mounting position and a second mounting position and movable between an open position and a closed position for selectively providing access to the loading opening, wherein the door defines a recess, and wherein the door extends between a top and a bottom along a vertical direction and a first side and a second side along a lateral direction, and wherein the recess is centered between the first side and the second side and is positioned at or proximate the top of the door; a striker removably mounted to the door for engaging the latch when the door is in the closed position, the striker spaced from the recess, and wherein the locking bolt is deployed in the withdrawn position in the recess of the door to lock the door in the closed position during operation of the horizontal axis washing machine appliance.

17. The horizontal axis washing machine appliance of claim 16, wherein the door has a window and the window defines the recess.

18. The horizontal axis washing machine appliance of claim 16, wherein the door has a frame and the frame defines the recess.

* * * * *